US006830407B1

(12) United States Patent
Ochoa

(10) Patent No.: US 6,830,407 B1
(45) **Date of Patent: *Dec. 14, 2004**

(54) GUARDRAIL BEAM WITH ENHANCED STABILITY

(75) Inventor: Carlos M. Ochoa, College Station, TX (US)

(73) Assignee: Icom Engineering, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/663,327

(22) Filed: Sep. 18, 2000

Related U.S. Application Data

(63) Continuation-in-part of application No. 09/405,434, filed on Sep. 23, 1999, now Pat. No. 6,290,427.
(60) Provisional application No. 60/120,171, filed on Feb. 16, 1999.

(51) Int. Cl.[7] ..... E01F 15/00
(52) U.S. Cl. ..... 404/6; 404/6
(58) Field of Search ..... 404/6; 256/13.1

(56) References Cited

U.S. PATENT DOCUMENTS

| | | | |
|---|---|---|---|
| 1,847,025 A | 2/1932 | Stockard | |
| 1,849,167 A | 3/1932 | Bente | |
| 1,974,232 A | 9/1934 | Brown | 256/13.1 |
| 1,989,763 A | 2/1935 | McFarland | 256/18.1 |
| 2,007,185 A | 7/1935 | Edgecombe | 256/13.1 |
| 2,047,436 A | 7/1936 | Shepherd | 256/13.1 |
| 2,047,990 A | 7/1936 | Carswell et al. | 256/13.1 |
| 2,060,673 A | 11/1936 | Hick | 256/13.1 |
| 2,085,098 A | 6/1937 | Height et al. | 256/13.1 |
| 2,088,001 A | 7/1937 | Schultz | 256/13.1 |
| 2,089,929 A | 8/1937 | Brickman et al. | 256/13.1 |
| 2,091,195 A | 8/1937 | Dennebaum | 267/69 |
| 2,091,925 A | 8/1937 | Heltzel | 256/13.1 |

(List continued on next page.)

FOREIGN PATENT DOCUMENTS

| | | | |
|---|---|---|---|
| CH | 376 535 | 2/1960 | |
| CH | 378 358 | 6/1961 | |
| CH | 433 422 | 8/1966 | E01F/15/00 |
| FR | 1 258 539 | 7/1961 | |
| FR | 2 607 841 | 6/1988 | E01F/15/00 |

OTHER PUBLICATIONS

Existing Guardrail Shapes.
O–Rail (brochure), TrinityIndustries, Inc. 1999.
Standard Specification for Corrugated Sheet Steel Beams for Highway Guardrail, AASHTO Designation: M 180–89, pp. 309–313.
Standard Specification for Corrugated Sheet Steel Beams for Highway Guardrail, AASHTO Designation: M 180–79, pp. 419–423.
PCT Search Report U.S. 99/29848, May 4, 2000.

*Primary Examiner*—Gary S. Hartmann
(74) *Attorney, Agent, or Firm*—Baker Botts L.L.P.

(57) ABSTRACT

A guardrail beam for installation along a roadway includes a first edge and a second edge. A plurality of crowns may be disposed longitudinally along the guardrail beam between the first edge and the second edge. A first fold may be disposed upon the first edge and a second fold may be disposed upon the second edge. The beam may also include an upstream end, a downstream end and an intermediate portion disposed between the upstream and downstream ends. The first and second folds may form generally tubular first and second curls having elliptical cross sections and located within the upstream and intermediate portions. The guardrail beam may also include hemmed portions at the first edge and/or second edge at the downstream ends of the guardrail beam. In a particular embodiment, one or more fluted beads may be disposed longitudinally along at least one crown.

20 Claims, 6 Drawing Sheets

U.S. PATENT DOCUMENTS

| | | | | |
|---|---|---|---|---|
| 2,135,705 | A | 11/1938 | Florance | 256/13.1 |
| 2,168,930 | A | 8/1939 | Bradshaw | 256/13.1 |
| 2,204,559 | A | 6/1940 | Ahles | 256/13.1 |
| 2,228,652 | A | 1/1941 | Dailey | 256/13.1 |
| 2,536,760 | A | 1/1951 | Martin et al. | 256/13.1 |
| 2,776,116 | A | 1/1957 | Brickman | 256/13.1 |
| 2,979,307 | A | 4/1961 | Crone | 256/13.1 |
| 3,214,142 | A | 10/1965 | Brown et al. | 256/13.1 |
| 3,284,054 | A | 11/1966 | St. Pierre | 256/13.1 |
| 3,332,666 | A | 7/1967 | Gray | 256/13.1 |
| 3,417,965 | A | 12/1968 | Gray | 256/13.1 |
| 3,603,562 | A | 9/1971 | Glaesener | 256/13.1 |
| 3,776,520 | A | 12/1973 | Charles et al. | 256/13.1 |
| 3,845,936 | A | 11/1974 | Boedecker, Jr. et al. | 256/1 |
| 4,063,713 | A | 12/1977 | Anolick et al. | 256/13.1 |
| 4,222,552 | A | 9/1980 | Matteo, Sr. | 256/13.1 |
| 4,295,637 | A | 10/1981 | Hulek | 256/13.1 |
| 4,330,106 | A | 5/1982 | Chisholm | 256/13.1 |
| 4,423,854 | A | 1/1984 | Cobb et al. | 256/13.1 |
| 4,460,161 | A | 7/1984 | Grenga | 256/13.1 |
| 4,655,434 | A | 4/1987 | Bronstad | 256/13.1 |
| 4,928,928 | A | 5/1990 | Buth et al. | 256/13.1 |
| 5,044,609 | A | 9/1991 | Cicinnati et al. | 256/13.1 |
| 5,069,576 | A | 12/1991 | Pomero | 404/6 |
| 5,152,507 | A | 10/1992 | Lee | 256/13.1 |
| 5,407,298 | A | 4/1995 | Sicking et al. | 404/6 |
| 5,429,449 | A | 7/1995 | Baatz | 404/6 |
| 5,547,309 | A | 8/1996 | Mak et al. | 404/6 |
| 5,860,762 | A | 1/1999 | Nelson | 404/6 |
| 5,954,111 | A | 9/1999 | Ochoa | 160/201 |
| 5,957,435 | A | 9/1999 | Bronstad | 256/13.1 |
| 5,967,497 | A | 10/1999 | Denman et al. | 256/13.1 |
| 6,059,487 | A | 5/2000 | Haga et al. | 404/6 |
| 6,082,429 | A | 7/2000 | Ochoa | 160/201 |
| 6,142,452 | A | 11/2000 | Denman et al. | 256/13.1 |
| 6,149,134 | A | 11/2000 | Bank et al. | 256/13.1 |
| 6,173,943 | B1 | 1/2001 | Welch et al. | 256/13.1 |
| 6,260,827 | B1 | 7/2001 | Sicking et al. | 256/13.1 |
| 6,290,427 | B1 * | 9/2001 | Ochoa | 404/6 |

* cited by examiner

GUARDRAIL BEAM WITH ENHANCED STABILITY

RELATED APPLICATION

This application is a continuation in part of application Ser. No. 09/405,434 filed on Sep. 23, 1999 by Carlos M. Ochoa entitled Guardrail Beam With Enhanced Stability, now issued as U.S. Pat. No. 6,290,427 which claims priority to U.S. Provisional Application Serial No. 60/120,171 filed on Feb. 16, 1999.

This application is related to copending application Ser. No. 09/753,868 filed on Jan. 2, 2001 by Carlos M. Ochoa entitled Guardrail Beam with Improved Edge Region and Method of Manufacture currently pending.

This application is related to copending application Ser. No. 09/923,841 filed on Aug. 7, 2001 by Carlos M. Ochoa entitled Guardrail Beam With Enhanced Stability, currently pending.

TECHNICAL FIELD OF THE INVENTION

The present invention relates generally to roadway safety devices and more particularly, to a guardrail beam with enhanced stability.

BACKGROUND OF THE INVENTION

A goal of roadway safety is to provide a forgiving roadway and adjacent roadside for errant motorists. Guardrails are employed along a roadside to accomplish multiple tasks. Upon vehicle impact, a guardrail must react as a brake and shock absorber to dissipate the kinetic energy of the vehicle. Subsequently, the guardrail acts as a mechanical guide to redirect the vehicle away from hazards during deceleration and to prevent the vehicle from leaving the road, becoming airborne or rebounding into traveled lanes of traffic.

For many years, a standard heavy gauge metal guardrail known as the "W-beam" has been used on the nation's roadways to accomplish these tasks and others. Named after its characteristic shape, the "W-beam" is typically anchored to the ground using posts made of metal, wood or a combination of both.

Recently, there has been a vigorous effort to raise the performance standards which guardrails must satisfy. Increasingly stringent testing criteria have uncovered some deficiencies in the performance of standard "W-beam" guardrails. Accordingly, recent efforts have focused on the development of a new guardrail system that will accomplish safety goals more effectively.

One such design included a deeper and wider "W-beam." However, this change in geometry required a significant increase in hardware to attach adjacent sections of the beam at each splice. Such alternative systems have not gained widespread industry acceptance because they typically lacked the ability to efficiently interface with existing guardrail systems.

SUMMARY OF THE INVENTION

One aspect of the present invention is to provide an improved guardrail system for use in median strips and adjacent to roadways that more evenly spreads the stresses sustained during impact with a vehicle to create a more uniform, stable and predictable response. Another aspect is to provide a cost-effective, retrofitable guardrail which can be employed interchangeably along with, or in lieu of existing guardrail systems. Multiple splice bolt holes or slots associated with each guardrail beam are preferably provided to allow the guardrail beams to be used interchangeably with existing guardrail systems. Yet another aspect is to provide a lightweight guardrail with sufficient strength to meet or surpass highway safety standards. Still another aspect is to provide a guardrail system capable of dissipating the impact energy of a vehicle collision more effectively than existing guardrail systems.

Various technical benefits are attained in accordance with the teachings of the present invention by employing a guardrail beam with a first edge, second edge and a plurality of crowns disposed longitudinally between the first edge and the second edge. A first fold may be disposed longitudinally along the first edge and a second fold may be disposed longitudinally along the second edge. These folds may be integrally formed on a base sheet of steel or other material from which the guardrail beam is manufactured. Alternatively, the desired folds may be added either during manufacture or during installation of the guardrail by bonding, fastening, or welding additional portions as desired to a guardrail beam. For some applications, fold portions incorporating teachings of the present invention may be added to a base sheet prior to manufacturing a guardrail beam. These fold portions may be of constant or of variable thickness, and may for some applications be substantially thicker than the associated base sheet material to maximize the local or overall benefits of the present invention. In some applications twisted or layered fibers or wires may be included to aid in this purpose. For some applications a guardrail beam may be formed in accordance with teachings of the present invention from a base sheet having variable thickness and/or composition to enhance material and/or strength and stiffness redistribution as well as to provide local strengthening and fracture control or management such as for strengthening adjacent to splice bolt slots, or in the interior region to maximize overall crash energy is dissipation.

A guardrail beam incorporating teachings of the present invention may also include for the purpose of describing various embodiments of the invention, an upstream end, a downstream end spaced longitudinally from the upstream end, and an intermediate portion disposed between the upstream end and the downstream end. The first and second folds may form generally tubular first and second curls within the upstream and intermediate portions. Each curl may have an outer diameter with a value between approximately ⅜ of an inch and 2½ inches. For some applications, the first and second folds may be generally hemmed or otherwise modified adjacent to the downstream end to accommodate forming a splice with the upstream end of another guardrail beam.

In a particular embodiment, at least one fluted bead having a radius with a value between approximately 0.125 inches and 0.32 inches may be disposed longitudinally along at least one crown of a guardrail beam formed in accordance with teachings of the present invention. In another embodiment the flutes may be of variable shape and size, or they may be combined with axially oriented strips or fibers of the same or different materials as compared to the base sheet material in order to combine their strengthening and/or energy absorbing effect with or to replace the flutes. The combination may include bonding, fastening, or welding of the strips or fibers on a base sheet or on a guardrail beam after being formed from a base sheet. Such strips or fibers may also be combined with edge folds in a similar fashion. These strips or fibers may resist damage, reinforce, or absorb energy in various ways, such as by being arranged to produce mechanisms for energy absorption, including but not limited to converting kinetic and/or potential energy into heat energy at a microscopic and/or macroscopic level during a vehicle collision. The strips and/or fibers may also serve as safety or cosmetic markings that signal or provide guidance to motorists, such as by light or electronic media.

A technical advantage of the present invention includes its ability to effectively withstand and distribute stresses sustained during impact with a vehicle. This enhanced stress distribution minimizes failure of the guardrail beam and provides for a more stable and predictable response during collision. Accordingly, the resulting guardrail beams can withstand significant forces of impact while maintaining adequate safety to vehicles, passengers, and bystanders.

Another technical advantage includes the use of thinner sheets of selected base sheet materials to form a guardrail beam which minimizes costs associated with fabrication, transportation and installation of the guardrail beam.

Still another technical advantage includes a splice bolt hole or slot configuration which facilitates the retrofit and/or replacement of existing guardrail systems with one or more sections of a guardrail beam formed in accordance with teachings of the present invention without requiring substantial modifications to existing equipment and other portions of each guardrail system.

Other technical advantages are readily apparent to one skilled in the art from the following figures, descriptions, and claims.

BRIEF DESCRIPTION OF THE DRAWINGS

For a more complete understanding of the present invention, and the advantages thereof, reference is now made to the following brief descriptions, taken in conjunction with the accompanying drawings and detailed description, wherein like reference numerals represent like parts, in which.

DETAILED DESCRIPTION OF THE INVENTION

Preferred embodiments of the present invention and its advantages are best understood by referring now in more detail to FIGS. 1–8 of the drawings, in which like numerals refer to like parts.

Figures 1, 1A:
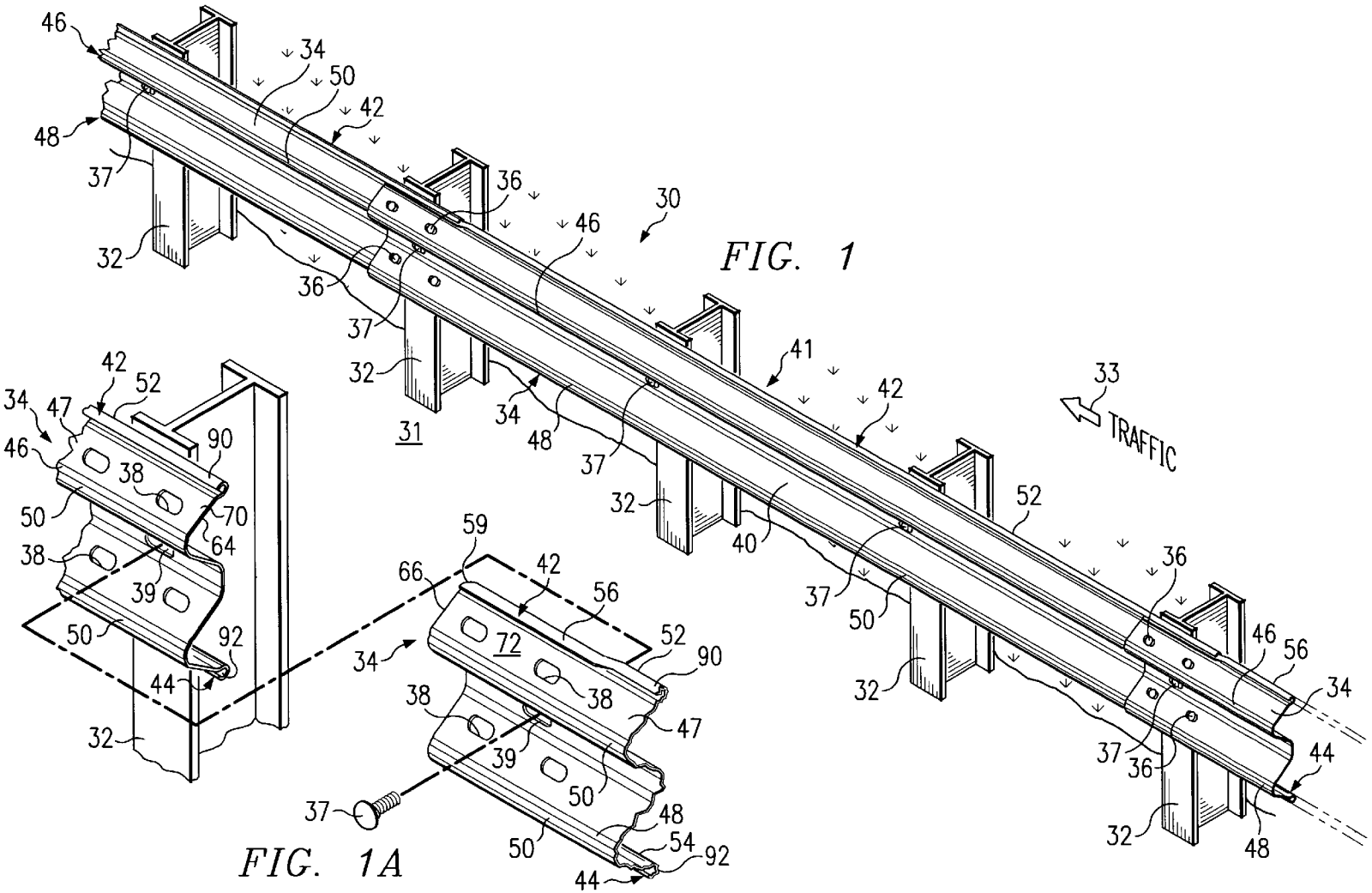
FIG. 1 is an isometric view of a guardrail system installed along a roadway, incorporating aspects of the present invention.
FIG. 1A is an isometric view, with portions broken away, illustrating a splice connection between adjacent sections of guardrail beams of the guardrail system of FIG. 1.

Referring to FIG. 1, guardrail system 30 is shown installed adjacent to roadway 31. The direction of oncoming traffic along roadway 31 is illustrated by directional arrow 33. Guardrail system 30 includes a plurality of support posts 32 anchored adjacent to roadway 31 with a plurality of guardrail beams 34 attached to support posts 32 and secured by post bolts 37. For illustrative purposes, FIG. 1 includes one complete guardrail beam 34 and two partial sections of adjacent guardrail beams 34 to illustrate the splice connections between adjacent sections.

Guardrail system 30 may be installed along roadway 31 in order to prevent motor vehicles (not expressly shown) from leaving roadway 31 and to redirect vehicles away from hazardous areas without causing serious injuries to the vehicle's occupants or other motorists. Guardrail systems incorporating aspects of the present invention may be used in median strips or shoulders of highways, roadways, or any path which is likely to encounter vehicular traffic.

Support posts 32 are provided to support and maintain guardrail beams 34 in a substantially horizontal position along roadway 31. Posts 32 are typically anchored below or alongside roadway 31. Posts 32 may be typically fabricated from wood, metal, or a combination of wood and metal. "Break away" support posts may be provided to facilitate a predetermined reaction to a specified crash event.

The number, size, shape, and configuration of support posts 32 may be significantly modified within the teachings of the present invention. For instance, support posts may be formed of a material that will break away upon impact, such as wood. In one embodiment, support posts satisfactory for use with the present invention may be formed from two wood sections. The first wood section (not expressly shown) may be disposed underneath roadway 31. The second wood section (not expressly shown) may be disposed above roadway 31 with means for connecting the first wood section with the second wood section. Similarly, support posts 32 may be comprised of two metal sections, the first metal section being an I-beam disposed below roadway 31 and the second metal section being an I-beam disposed above roadway 31, with means for connecting the I-beam sections together. Alternatively, support posts 32 may comprise a combination of metal, wood, or other satisfactory materials such as composite materials. Various types of support posts will be described later in more detail, in conjunction with the alternative embodiments of FIGS. 5 and 6.

Referring now to FIGS. 1 and 1A, guardrail beams 34 are secured to support posts 32 through a plurality of post bolt slots 39 and corresponding post bolts 37. Similarly, adjacent guardrail beam or panels 34 are coupled with one another by a plurality of splice bolts 36 protruding through splice bolt slots 38. The number, size and configuration of bolts 36 and 37, and slots 38 and 39 may be significantly modified within the teachings of the present invention. In the illustrated embodiment, the configuration of slots 38 and 39 and bolts 36 and 37 comply with governing standards such as American Association of State Highway Transportation Officials (AASHTO) Designation 180-89. Suitable hardware, including nuts and washers (not expressly shown) may be provided to secure bolts 36 and 37 within their respective slots. Various other mechanical fastening techniques and components may be employed within the teachings of the present invention.

Guardrail beams 34 are preferably formed from sheets of a base material such as steel alloys suitable for use as highway guardrail. In one embodiment, guardrail beam 34 may also be generally designed and fabricated according to AASHTO Designation M180-89. Although the embodiment illustrated in FIG. 1 has a generally "W-Beam" shape, other shapes, including but not limited to a "Thrie-Beam," may be suitable for use within the teachings of the present invention, including the embodiments illustrated in FIGS. 6 and 7.

Guardrail beam 34 may be formed in accordance with teachings of the present invention to demonstrate improved safety performance. This is motivated by the fact that recently, increased interest in the need for more stringent safety requirements has culminated in the issuance of the National Cooperative Highway Research Program Report 350 (NCHRP 350). The highest performance standards of NCHRP 350 require most new safety hardware to be tested with larger vehicles than required by previous standards. NCHRP 350 evaluates highway safety hardware within three areas: structural adequacy, occupant risk, and vehicle trajectory. Each area has corresponding evaluation criteria. The Federal Highway Administration (FHWA) has officially adopted these new performance standards and has ruled that all safety hardware installed after August of 1998 will be required to meet the new standards.

Figure 2:
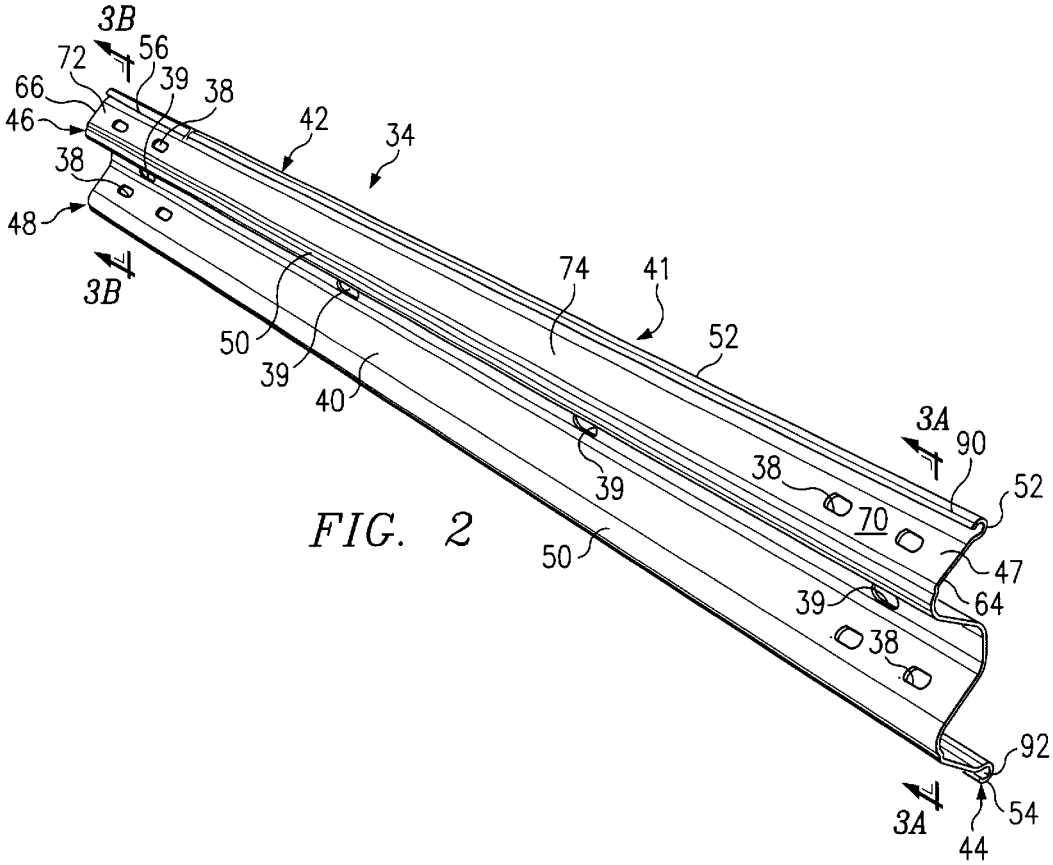
FIG. 2 is an isometric view of a guardrail beam or panel incorporating teachings of the present invention.

The geometric configuration of guardrail beam 34, as illustrated in FIGS. 1 and 2, enhances its ability to respond in a more uniform and predictable manner during crash testing and in-service impacts or collisions. Guardrail beam 34 comprises front face 40, and a rear face 41, disposed between first edge 42 and second edge 44. Front face 40 is preferably disposed adjacent to roadway 31. First crown 46 and second crown 48 are formed between first edge 42 and second edge 44. Each crown 46 and 48 may be generally arcuate or shaped like a bowl with a flat face. Each crown may also include at least one fluted bead 50, which will be described later in more detail. See FIG. 4 for one example of fluted bead 50. In a "Thrie-Beam" configuration (see FIGS. 6 and 7), guardrail beam 834 includes three crowns 246, 248 and 250.

First edge 42 and second edge 44 of guardrail-beam 34 terminate at respective folds 52 and 54. For the embodiments illustrated in FIGS. 2, 3A, and 4, folds 52 and 54 turn inwardly toward front face 40 of guardrail beam 34, facing one another. The geometry of respective folds 52 and 54 may vary along the length of edges 42 and 44.

The upstream end 70 of each section of guardrail beam 34 is generally defined as the portion beginning at upstream edge 64 and extending approximately thirteen (13) inches along guardrail beam 34 toward downstream edge 66. Similarly, downstream end 72 of each section is generally defined as the portion of guardrail beam 34 beginning at downstream edge 66 and extending approximately thirteen (13) inches toward the associated upstream edge 64. Intermediate portion 74 of each section of guardrail beam 34 extends between respective upstream end 70 and downstream end 72. The dimensions of ends 70 and 72 may each be substantially modified within the present teachings.

Folds 52 and 54 include tubular curls 90 and 92 which preferably extend substantially the entire longitudinal length of first edge 42 and second edge 44, respectively, with the exception of downstream end 72. At downstream end 72, first edge 42 and second edge 44 terminate at folds 52 and 54 which have hemmed or modified portions 56 and 58 (see FIGS. 1A and 3B), respectively. The respective configurations of curls 90 and 92 and portions 56 and 58 may vary along the longitudinal length of guardrail beam 34.

The edge conditions discussed and illustrated throughout this application as occurring at the first edge or second edge of a guardrail beam, may be utilized interchangeably on either the first edge, second edge, or both. Furthermore, the edge conditions prevalent at the downstream ends, upstream ends, and/or intermediate portion of a given guardrail beam may also be utilized interchangeably. It will be recognized by those skilled in the art, that a single guardrail beam may employ one particular edge condition at the first edge, and the same or a different edge condition at the second edge, and that these edge conditions may occur at either of the upstream or downstream ends, the intermediate portion, or both.

As used throughout this application, the terms "edge condition" and "edge region" refer to the configuration of the termination at either the first edge (42) or the second edge (44) of the guardrail beam. Also, as utilized throughout this application, the term "hemmed" refers to a fold that has been altered in shape by adjusting one or more dimensions. This may be done for example to allow a "hemmed" edge to interlock with a fold, as discussed below. Thus, a curled edge of one guardrail beam may be slightly altered to fit inside of a curled edge of another guardrail beam.

The tubular curl feature is discussed in more detail in the following paragraph. The curls are tubular features, preferably open-sections, that are made by shaping the free edges or edge marginal portions of the guardrail cross-section into an elliptical, preferably circular, cross-sectional shape. As used herein, a circular cross-section is considered to be a special case of an elliptical cross-section. The term "characteristic diameter" refers to a constant diameter in the case of a circle, while other elliptical shapes will have major and minor axes or diameters, with the major axis or diameter being the "characteristic diameter." Even though some configurations of a slightly non-circular elliptical shape may be more desirable in some applications, the circular cross-section is generally preferable, because it is simpler to manufacture, while still achieving the desired benefits to a significant degree.

It is important to contrast the edge curl approach against other possible edge treatment approaches by noting that the dimensional order of size effect related to imperfections or damage described above for the curl cannot be achieved by simply folding the edge over, either once or multiple times, because in this case the characteristic dimension will be defined by the fold edge diameter and not by the length of overlap of the fold. This is because the overlap direction is transverse to the edge and may quickly move out of the edge peak stress region, and because the edge fold diameter defines the maximum distance over which the highest edge stresses may be effectively spread.

The stress concentration and damage resistance effect generally found in elliptical or circular open-section tubular shapes or "edge curls" is contrasted with that of tubular sections of rectangular cross-sectional shapes, including folded edges, and to open-section tubular shapes of softened corner rectangular or polygon cross-sectional shapes in that the characteristic diameter may be defined in each of these other cases by the fold diameter or by the softened corner diameter nearest to the guardrail edge, as opposed to the overall diameter of the edge curl section.

It is important to note that throughout this application a rectangular or polygon cross-section with very softened corners is considered to be in effect an imperfect ellipse or circle. In some instances, quasi-elliptical or quasi-circular cross-sections, imperfect ellipses, and imperfect circles, in the form of rectangular or polygon cross-sections with very softened corners may function adequately, but may also be more difficult to manufacture and will be somewhat less effective than a generally circular curl. Thus, when such variations are encountered, they may be approximated and evaluated for the present purposes as ellipses.

Referring now to FIGS. 1 and 1A, a splice connection between adjacent and overlapping guardrail beams 34 is illustrated. Upstream end 70 and downstream end 72 of adjacent guardrail beams 34 are configured to allow tubular curls 90 and 92 to interlock with hemmed portions 56 and 58 (see FIGS. 3A and 3B). Guardrail beams 34 are typically fabricated from a base sheet of flexible sheetmetal type material which allows adjacent beams to be deformed and "snapped" together to form an interlock or overlap at each splice connection. In practice, the interlock or overlap between adjacent guardrail beams 34 is preferably formed in a nested fashion, as opposed to adjacent guardrail beams 34 sliding together, in order to facilitate installation.

The interlock at each splice connection helps to keep guardrail beams 34 in alignment with respect to each other during a crash event. The interlock also operates to generally channel large loads encountered by guardrail system 30 during a crash event in the axial direction along the length of guardrail beam 34. This simple, largely uniaxial load path is optimum for performance of a bolted splice joint or connection such as shown in FIG. 1A and for the overall uniform response of guardrail system 30. This results in maximum energy dissipation from a colliding vehicle, and in the optimum overall performance of guardrail system 30 being achieved.

The interlock formed at the splice connection between adjacent guardrail beams 34 provides a more predictable response to externally applied forces, for example, during a crash event. When a vehicle contacts or collides with a guardrail, local deformation typically occurs in the local region of the contact and very high axial (stretching) loads are placed on the guardrail. These high loads act along a longitudinal axis parallel (generally horizontal) with the guardrail beam, extending from the upstream end to the downstream end. A guardrail beam formed in accordance with teachings of the present invention will more uniformly distribute loads from a crash event along the longitudinal-axis and between the first edge and the second edge along a lateral axis (generally vertical) perpendicular to the longitudinal axis.

Splice bolt slots 38 and post bolt slots 39 are typically elongated and have somewhat larger than usual tolerances as compared with the diameter of bolts 36 and 37, which extend respectively therethrough. Slots 38 and 39 thus allow bolts 36 and 37 additional movement to accommodate alignment during the installation process. While this helps during the installation process, it does not help the strength of the splice.

In many existing guardrails this additional movement at each splice connection makes it an unstable region, and thus a weak link. This is because the loads are poorly controlled and relatively non-uniform at this location during a crash event. In these cases the guardrail beams often tend to fail first near the splice bolts positioned at the lowermost portion of any particular guardrail beam. This failure mode is sometimes associated with the non-uniform, local deformation at the respective splice. It can also be aided by the bolt loads related to bending of the respective splice in the vertical plane. However, the interlock between adjacent guardrail beams 34 formed in accordance with the teachings of the present invention minimizes non-uniform deformation at the respective splice. It allows adjacent sections of guardrail beam 34 to slide axially relative to one another while minimizing both local bending in the vertical plane and separation of the beams at the splice. In summary, non-uniform deformation can frequently lead to local concentration of stresses that may cause failure of the respective splice if this condition is not minimized. Also, forces from applied loads are passed more uniformly between adjacent interlocking sections of guardrail beam 34 through splice bolts 36.

The extreme edges of hemmed portions 56 and 58, at their termination adjacent to trailing edge 66, may be chamfered as generally designated in FIG. 1A with the reference numeral 59, at approximately a forty-five-degree angle. Also, each fold 52 and 54 may be trimmed and mitered in order to avoid any rough edges. In this manner, the extreme corners and edges of hemmed portions 56 and 58 of one guardrail beam 34 are less likely to tear an adjacent guardrail beam 34 at tubular curls 90 and 92. This configuration accommodates axial sliding of one guardrail beam 34 with respect to an adjacent guardrail beam 34 without forming a snag or tear.

The chamfered edges 59 are particularly useful where hemmed portions 56 and 58 are coupled with folds 52 and 54 of an adjacent guardrail beam 34. In some instances the folds may be partially removed or trimmed in order to accommodate various manufacturing operations, or to facilitate guardrail installation. Similarly, the hemmed portions may have a non-uniform folded shape in order to accommodate manufacturing or installation, or simply to maximize the effectiveness of this region during service.

Figure 3A:
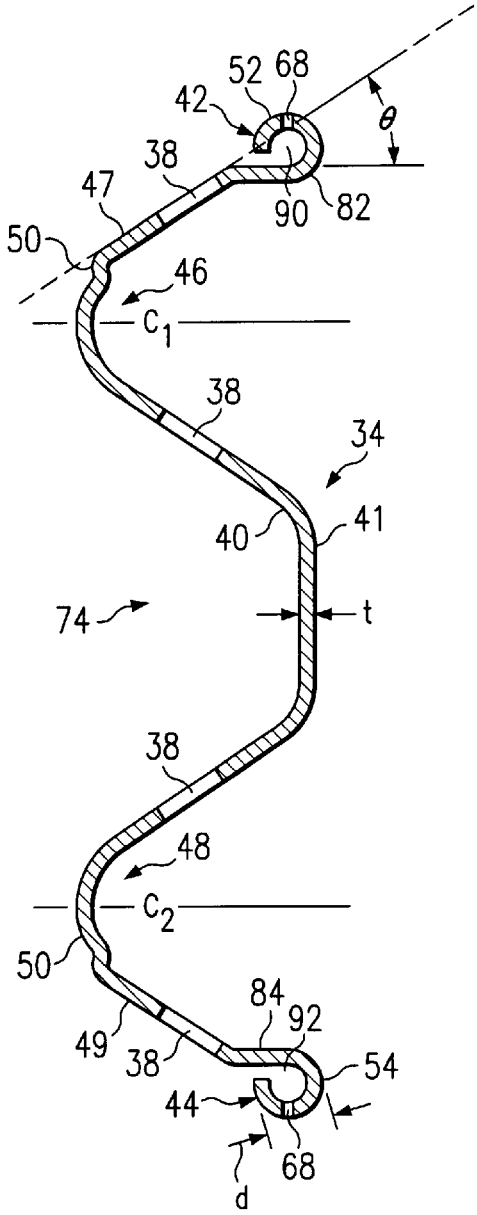
FIG. 3A is a schematic drawing in cross section, taken along lines 3A—3A of the guardrail beam of FIG. 2.

As illustrated in FIG. 3A, a plurality of weep holes 68 may be incorporated into tubular curls 90 and 92. Weep holes 68 will preferably operate to drain any water which collects in tubular curl 92 and thus minimize the buildup of water within the lowermost tubular curl 92 which may otherwise lead to corrosion. In the illustrated embodiment, weep holes 68 are provided in the lowermost tubular curl 92 as well as the uppermost tubular curl 90 in order to provide a reversible application such that either tubular curl 90 or 92 may be installed adjacent to roadway 31 as the lowermost position of guardrail beam 34.

In one embodiment, weep holes 68 may be provided every two to three longitudinal feet along guardrail beam 34. In the same embodiment, the diameter of weep holes 68 may be approximately equal to or less than one quarter of the diameter of tubular curl 92. The size, number and configuration of weep holes may be significantly varied within the teachings of the present invention, as required by given ambient conditions.

The configuration of FIG. 1A illustrates one embodiment for an interconnection or splice joint between adjacent sections of guardrail beam 34 of the present invention. Guardrail beam 34 may also be designed within the present teachings to be used in conjunction with, and alongside conventional guardrail beams (not expressly shown). Thus, folds 52 and 54 and the overall geometry of guardrail beam 34 can be configured within the present teachings to allow a combination between guardrail beam 34 and a conventional guardrail beam within a single guardrail system, while substantially maintaining the benefits described herein. Accordingly, guardrail beams 34 of different configuration may be incorporated together into existing guardrail systems as needed, and an entire retrofit of any particular guardrail system is not required in order to recognize the benefits of the present invention.

The cross sectional configuration of folds 52 and 54, taken through upstream end 70, is illustrated in FIG. 3A. At this location and throughout the length of intermediate portion 74, folds 52 and 54 have the general configuration of tubular curls 90 and 92. Tubular curls 90 and 92 have a generally circular cross section with a circumference which may extend approximately two hundred and seventy degrees of a unit circle centered within tubular curls 90 and 92. In another embodiment (not expressly shown), tubular curls 90 and 92 may extend approximately three hundred and sixty degrees along a unit circle. As shown in more detail in FIG. 8, tubular curls 90 and 92 may have an outer diameter d selected between a range of approximately three eights of an inch (⅜") and two and one half inches (2½"). Examples of specific dimensions and ranges of dimensions associated with tubular curls 90 and 92 are listed in Table I.

A more precise definition of the diameter d is provided as follows. While a circular shape for tubular curls 90 and 92 is preferred, a generally elliptical shape would function adequately in most instances. A tubular bead or curl of an elliptical shape has a major axis and a minor axis. Diameter or dimension d for an elliptical shape is interpreted herein for all purposes as the average dimension between the major axis and the minor axis. This interpretation is also applied to imperfect shapes or to shapes that are similar to rectangles or polygons, including those having one or more arcuate portions. The major and minor axes are at right angles to each other and are defined as the major and minor dimensions of the open or closed tubular section. To provide an effective elliptical shape for tubular beads 90 and 92, the length of the minor axis should be at least about 20 percent of the length of the major axis. The terms "elliptical" shape and "elliptical" cross section are to be interpreted herein for all purposes as including circular shapes and circular cross sections.

Tubular curls 90 and 92 cooperate with each other to encourage guardrail beam 34 to maintain its original configuration when subjected to a crash event. Tubular curls 90 and 92 have a tendency to return or snap back to their original alignment which influences the behavior of the cross section of guardrail beam 34 extending there between. For purposes of describing this feature of the invention, tubular curls 90 and 92 function similar to cables which are stretched between adjacent support posts and are attached to respective edges of a guardrail. The tubular curls provide support against both longitudinal and lateral deformation because the respective edge regions associated with tubular curls 90 and 92 have a tendency to return or snap back to their original position when subjected to axial loads from a crash event.

Tubular curls 90 and 92, along with other features of the present invention allow guardrail beams 34 to be formed from a sheet of base material (not expressly shown) which may be substantially thinner than sheets of base material used to form conventional W-beam guardrails since the present invention results in guardrail beams 34 having the same or even greater resistance to unstable behavior and/or local deformation during a crash event. Axial loads applied to guardrail beam 34 have a tendency to provide additional stiffening which resists such deformation. Guardrail beam 34 generally has an increased ability to dissipate kinetic energy from a crash event since grater forces or loads are generally required to deform guardrail beam 34 as compared to conventional W-beam guardrails. The ability to dissipate kinetic energy is a significant factor in slowing or reducing the speed of a vehicle during a crash event.

In another embodiment, guardrail beam 34 may be bent around a corner, or an obstacle. This bending of guardrail beam 34 will frequently deform folds 52 and 54 into an elliptical configuration, rather than a generally circular cross section. The resulting generally elliptical configuration maintains many of the benefits described herein.

The cross section of FIG. 3A illustrates at least one fluted bead 50 associated with respective first crown 46 and second crown 48. Fluted beads 50 effectively redistribute material and stiffness from areas of less significance to areas of critical importance during a crash event. Fluted beads 50 help to direct deformation of guardrail beam 34 in a direction generally parallel to guardrail beam 34, thus absorbing more energy by spreading the deformation of guardrail beam 34 in the longitudinal direction. For some applications, the radius of each fluted bead 50 may be between approximately 0.125 inches and 0.32 inches. For one embodiment each fluted bead 50 may have a radius of approximately 0.1625 inches.

Although one fluted bead 50 is illustrated on each crown 46 and 48 in the embodiment of FIG. 3A, the total number of fluted beads 50 may be increased or decreased along the length of a single guardrail beam according to various design considerations within the teachings of the present invention. In one particular embodiment (not expressly shown), five fluted beads 50 may extend longitudinally along the tip of each crown 46 and 48. In the same embodiment, all of the fluted beads 50 occurring upon first crown 46 are within one and one-half inches of center line C1. Similarly, all of the fluted beads 50 associated with second crown 48 may be within one and one-half inches of centerline C2.

Figure 7:
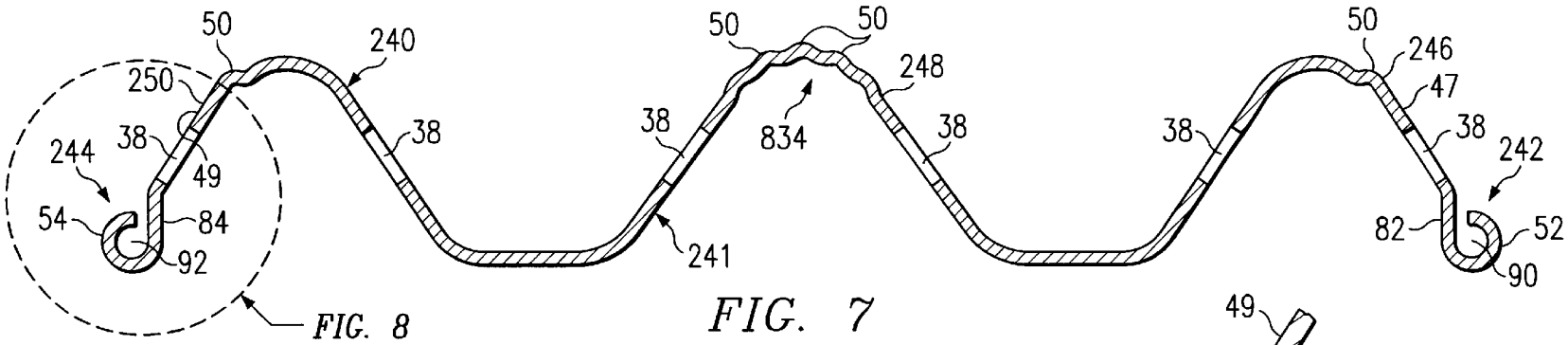
FIG. 7 is a schematic drawing in cross section, illustrating a guardrail beam associated with the guardrail system shown in FIG. 6.

Guardrail beam 834 as shown in FIG. 7 includes multiple fluted beads 50 on crown 248. These fluted beads 50 are generally rounded and a smooth transition provided between adjacent fluted beads 50. This minimizes stress concentrations typically associated with sharp transitions or bends. These shapes are also easier to manufacture and provide reduced wear and tear on tools of manufacture.

For purposes of describing various features of the present invention, front face 40 of guardrail beam 34 will be described with respect to an upper face 47 formed adjacent to first edge 42 and lower face 49 formed adjacent to second edge 44. As previously noted, guardrail beam 34 may be fabricated with generally symmetrical configurations such that first edge 42 may be disposed at the top of the associated guardrail system and for other applications first edge 42 may be disposed at the lower edge of the associated guardrail system (not expressly shown) adjacent to a roadway. Guardrail beam 834 which will be discussed later in more detail may also be formed with an upper face 47 and a lower face 49 with substantially the same configuration as will be described with respect to guardrail beam 34.

For the embodiment of the present invention as shown in FIGS. 1, 1A and 2A, upper face 47 of each guardrail beam 34 preferably includes a respective pair of splice bolt slots 38 formed in upstream end 70 and downstream end 72. Lower face 49 also preferably includes corresponding pairs of splice bolt slots 38. See FIGS. 3A, 3B, 7 and 8. The dimensions and configurations associated with upper face 47 and with lower face 49, including their respective splice bolt slots 38 and folds 52 and 54 are for this embodiment substantially the same since this embodiment has been substantially simplified to obtain maximum manufacturing economies, especially for the roll form process. Similarly, the detailed configuration of lower face 49, second fold 54 and second edge 244 of guardrail beam 834 is representative of corresponding dimensions and configurations associated with upper face 47 of guardrail beam 834 and upper face 47 and lower face 47 of guardrail beam 834.

Figure 8:
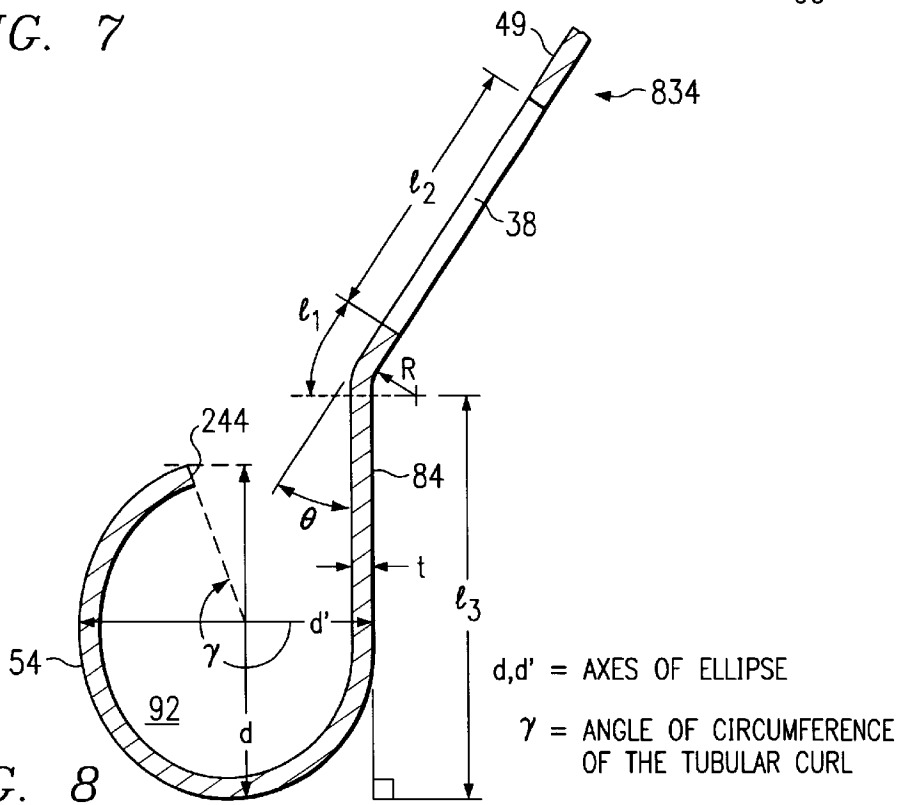
FIG. 8 is a schematic drawing in cross section, illustrating the dimensions of an edge region satisfactory for use with the guardrail systems of FIGS. 1, 5 and 6.

As emphasized in FIG. 8, the length $l_2$ of splice bolt slots 38 may be approximately between five eights of an inch (⅝") and one inch (1") for some embodiments that are designed to interface with prsent W-beam guardrail. As previously noted, the configuration and dimensions of upper face 47 and lower face 49 may correspond generally with each other. Upper face 47 preferably terminates near the edge of curl flange 82. Lower face 49 terminates near the edge of curl flange 84. In one embodiment specifically designed to interface with present W-beam guardrail, the length $l_1$ from splice bolt slot 38 to curl flange 84 may be between approximately 0.0625 inches and 0.25 inches. At the point of termination, the bend radius R between the lower face 49 and the curl flange 84 may form an angle θ between approximately thirty degrees and one hundred and twenty degrees, in either the "+θ" or the "−θ" directions. For purposes of clarification, θ may be understood in FIG. 8 to increase in the counter-clockwise direction with respect to the plane of the lower face, 49.

The radius R may be chosen to be approximately equal to or less than three times the guardrail beam thickness. This range produces a novel and important mechanism in combination with the curl flange and edge fold to resist fracture due to nearby splice bolt load related stress intensities between the splice bolt slot and the guardrail edge.

For the embodiment of the present invention as shown in FIG. 8, the angle θ defined by lower face 49 and curl flange 84 represents a positive angle of approximately thirty degrees. For some applications upper face 47 and curl flange 82 and lower face 49 and curl flange 84 may define a shape corresponding to a negative angle θ. For several guardrail beam configurations forming an angle of at least approximately thirty degrees between the upper face and its respective curl flange or the lower face and its respective curl flange, the result can be substantially enhanced performance of the guardrail beam during a vehicle collision, as explained in the following paragraphs.

Curl flange 82 forms the transition between upper face 47 and tubular curl 90. Curl flange 82 and tubular curl 90 cooperate to form an unusual and novel edge stiffening effect for the internal structure. The special combination of geometries that maximize this novel effect are described below. Curl flange 84, lower face 49 and tubular curl 92 have a similar approach for configuration and dimensions. The resulting stiffening is of great importance because it minimizes possible buckling of the entire guardrail beam 34 during a crash event. Furthermore, by maximizing the corresponding length $l_3$ of curl flange 84, the total area of the respective regions between curl edge 242 and upper face 47 and corresponding between curl edge 244 and lower face 49 is maximized, thus giving even greater stiffening. For some applications, the corresponding length $l_3$ of each curl flange 82 and 84 may be approximately between three quarters of an inch (¾") and one and one half inches (1½").

As illustrated in FIGS. 3A and 8, an angle θ is formed in combination with a radius R, at the transition between upper face 47 and curl flange 82 and between lower face 49 and curl flange 84. In the illustrated embodiment, angle θ is approximately between thirty and thirty-five degrees and R is approximately equal to or less than about three times the local guardrail beam thickness. This special combination of angle and radius triggers the novel edge stiffening behavior and simultaneously strengthens the edge against fracture and facilitates the incorporation of guardrail beams 34 into existing guardrail systems. This highly beneficial combination of form and function is unique and unusual. It may be noted that the angle θ may be significantly modified for different embodiments or within the same embodiment, along the guardrail length between a positive or negative range of thirty to one hundred and twenty degrees with respect to the corresponding upper or lower face within the teachings of the present invention in combination with a sufficiently small Radius R while still achieving the novel edge-stiffening effect.

Figure 3B:
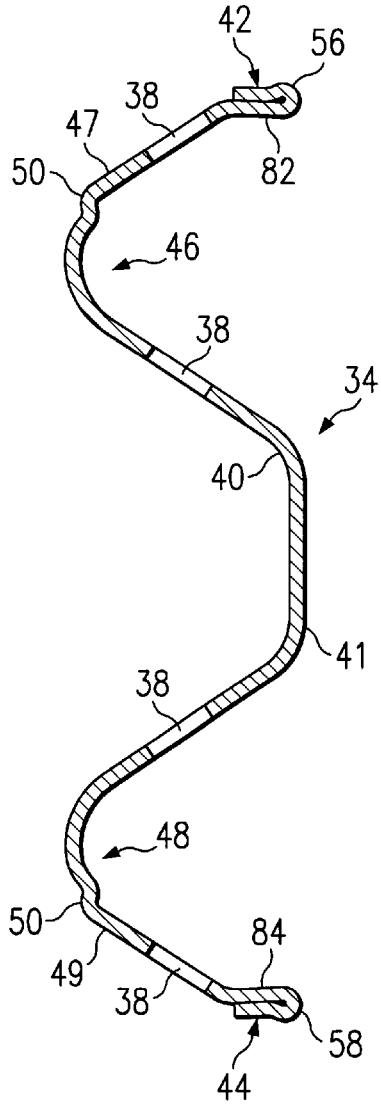
FIG. 3B is a schematic drawing in cross section, taken along lines 3B—3B of the guardrail beam of FIG. 2.

FIG. 3B illustrates a cross sectional configuration of modified folds 52 and 54, taken through downstream end 72. As shown, modified folds 52 and 54 at downstream end 72 comprise hemmed portions 56 and 58. In one embodiment hemmed portions 56 and 58 allow additional lengths or sections of guardrail beam 34 to be installed on existing sections of guardrail beam 34 or on conventional guardrail beams, with an overlap of approximately thirteen inches.

The following description is given in order to further highlight some of the novel features and benefits of the present invention. A vehicle traveling along the right side of roadway 31 will typically approach from upstream end 70 or leading edge 64 and subsequently depart from downstream end 72 or trailing edge 66 of guardrail beam 34. Each section of guardrail beam 34 (FIG. 2) is preferably joined with additional sections of guardrail beam 34 such that they are overlapped in the direction of oncoming traffic to minimize exposed edges which may "snag" a vehicle or object as it travels along front face 40 of guardrail beam 34. Accordingly, one section of guardrail beam 34 would be installed at leading edge 64 on front face 40 of a downstream guardrail beam 34, typically forming an overlap of approximately thirteen inches. An additional section guardrail beam installed downstream at trailing edge 66 may be installed on rear face 41 of guardrail beam 34, forming an overlap of approximately thirteen inches.

Folds 52 and 54 provide for more uniform stress distribution across the associated guardrail section during vehicle impact. This allows more material to deform during a crash event thereby absorbing additional energy. Guardrail beams 34 are subject to a tremendous amount of twisting during a crash event which results in a significant amount of stress concentrating on first edge 42 and second edge 44. Conventional guardrail beams do not contain folds 52 and 54 and typically terminate with "blade edges" at the top and bottom of the guardrail. These edges are susceptible to imperfections in the sheet of base material as well as damage during manufacture, shipping, handling, and installation. Imperfections along the edges of conventional guardrail beams may become stress concentration points or focal points at which failure of the guardrail can initiate during impact, and thus frequently result in tearing of the guardrail.

The actual mechanism and nature of this effect may be described briefly as follows. Even a perfect, smooth "blade edge" of a conventional "W-beam" will experience a very localized region of high stress gradient due to the characteristic edge stress concentration associated with open sections of guardrail under bending loads. This can cause the initiation of an edge "bulge" or "crimp" on a perfect, smooth blade edge as an imperfection that can grow or propagate easily and rapidly. This stress concentration may be made worse and even compounded by the presence of any relatively small edge imperfections in geometry or material, even those on the order of size of the thickness of the sheet of base material used to fabricate conventional guardrail beams.

This inherent and characteristic weakness of substantially all conventional guardrail beams is addressed by the following synergystic and novel apsects of the present invention. These include the redistribution of material, of strength, and of stiffness in various combinations that work together synergistically to improve guardrail system performance. Folds 52 and 54 stabilize guardrail beam 34 and make it more resistant to twisting while also spreading stresses at first edge 42 and second edge 44 thereby substantially decreasing the tendency of guardrail beam 34 to tear upon impact. This allows more uniform deformation of guardrail beam 34 between edges 42 and 44, for example, deformation of first and second crowns 46 and 48, while edges 42 and 44 remain relatively aligned with one another and generally maintain their strength and stiffness. Accordingly, forces or loads may transfer more uniformly in the upstream to downstream direction through guardrail beam 34 axially. Forces will not tend to deviate largely in direction from a lateral axis running parallel with edges 42 and 44.

Folds 52 and 54 simultaneously maximize the edge strength and stiffness of guardrail beam 34, which makes guardrail beam 34 resistant to tear at its midsection, and prevents cracks from forming. In one embodiment, the optimum range of traverse about a control axis of tubular curl 90 of FIG. 3A is approximately between two hundred and two hundred and seventy degrees. It will be recognized, however, by those skilled in the art that for guardrail beams 34 with edge conditions, or tubular curls 90 and 92, traverses about a central axis ranging from approximately zero degrees to a full three hundred and sixty degrees may be utilized in combination with other aspects of the present invention to produce significant synergistic benefits within the teachings of the present invention. Furthermore, the traverse about a central or centroidal axis of a given tubular curl may travel further than 360 degrees and begin or continue along an imaginary unit circle, lapping over any number of times and even doubling back one or more times in some embodiments. Accordingly, the size and local nature of tubular curls 90 and 92 may be significantly modified within the teachings of the present invention. Naturally, manufacturing simplicity must sometimes be favored over maximum possible performance efficiency.

The largest rigidity of guardrail beam 34 will typically be achieved when tubular curls 90 and 92 have the greatest diameter. Assuming d (see FIG. 8) equals the outer diameter of tubular curl 90, and t (see FIG. 8) equals the thickness of the sheetmetal, optimum performance may be achieved when d/t is less than or equal to 10. However, some benefit may be obtained for d/t less than about 50. This d/t range provides maximum rupture strength of the edge region. Also, for ultimate stackability during transportation and handling, large diameter curls 90 and 92 are preferred. The lower limit of the diameter of tubular curl 90 is related in part to the size required in order to splice into conventional guardrail systems. Tubular curl 90, for example, should be large enough to accept a blade edge of a conventional guardrail, in order to combine conventional guardrail beams with guardrail beams 34 of the present invention.

The diameters of tubular curls 90 and 92 may be constant throughout edges 42 and 44, except at downstream end 72, where hemmed portions 56 and 58 occur. This simplifies fabrication. In another embodiment, tubular curls 90 and 92 may have larger diameters at upstream ends 70 in order to provide a simplified connection with hemmed portion 56 and 58 of an adjacent guardrail beam 34, or with the blade edges associated with conventional guardrail beams.

Now consider the effectiveness of tubular curls 90 and 92 in resisting damage. In order to substantially impair the performance of guardrail beam 34, any edge imperfections must be approximately equal in size to the diameter d of folds 52 and 54, which is significantly larger than the thickness t of the associated sheet of base material used to fabricate conventional guardrail beams. Hence, folds 52 and 54 provide a more stabilized edge feature which more effectively resists damage and thus plays a highly synergistic role as it helps to dissipate the impact energy of a vehicle colliding with the guardrail. Hemmed portions 56 and 58 of FIG. 3B also provide for simplified installation of guardrail beam 34 within any given guardrail system having multiple guardrail beams or sections. It will be recognized by those skilled in the art that hemmed or modified curl portions 56 and 58 provide similar benefits associated with tubular curls 90 and 92, discussed and illustrated throughout this application by increasing the damage resistance of the edge.

The great importance of synergistic edge stabilization, edge stiffening, and damage resistance at the edges may be highlighted as follows. Upon a vehicle's impact with a guardrail, a dynamic response is typically induced in the guardrail. The response may include vibration of the guardrail in a direction parallel to the ground and perpendicular to the direction of the vehicle. Conventional guardrail beam sections may respond somewhat effectively when the vibrational waves are in a direction away from the vehicle. However, as the guardrail returns in a direction toward the vehicle, conventional guardrail beams tend to buckle or crimp at the first and second edges. At this point, the guardrail beam's ability to absorb energy by plastic moment may be significantly deteriorated. Furthermore, as the vehicle continues its path along the guardrail, it interacts with the edge of the buckled section. This may result in tearing of the sheet of base material initiating at the first edge or second edge and may occur in the region where two guardrail beams are overlapped.

The novel and synergistic effect of the geometric configuration of guardrail beam 34, including folds 52 and 54, first crown 46, second crown 48 and their associated fluted beads 50 includes retarding buckling by the appropriate redistribution of material about the cross section to optimize the section properties of guardrail beam 34 for a given sheet thickness, thereby increasing the failure resistance and buckling load capacity. This effective optimization of the distribution of mass and stiffness within the guardrail beam is somewhat similar to an I-beam's mass redistribution as compared to a solid rectangular section. Moreover, guardrail beam 34 exhibits capabilities beyond significantly improved strength and resistance to bending and deflection, as compared to conventional guardrail beams of the same sheet thickness. Folds 52 and 54 stabilize the guardrail and make it more resistant to twisting, while also distributing the stresses at first edge 42 and second edge 44, thereby decreasing peak edge stresses and thus the risk of a tear in the sheet of base material. Fluted beads 50 further redistribute the mass and strength of guardrail beam 34 to provide more material and strength at the region of impact during a collision.

Guardrail beam 34 of FIG. 2 may retain some of the standard dimensions associated with conventional "W-Beam" guardrails. Furthermore, splice bolt slots 38 may be configured to allow guardrail beam 34 to be installed along side of, and to be retrofitable with conventional "W-Beam" guardrail, when desirable. Guardrail beam 34 may also be used in conjunction with a variety of guardrail end treatments including those currently available and in widespread use.

Guardrail beam 34 of the present invention may be manufactured employing conventional "roll form" methods utilizing 0.068 inch thick steel alloy material. This is a substantially lighter gauge material than conventional guardrail beams and allows a total weight savings of approximately twenty-five percent (25%). Accordingly, guardrail system 30 of the present invention is stronger, allowing the component sheetmetal material to be lighter and thinner than in conventional applications. This simplifies installation, by allowing hemmed portion 56 and 58 to be deformed and interlocked with folds 52 and 54. Also, individual sections of guardrail beam 34 are lighter and easier to handle which simplifies maneuverability, for instance in lining up bolt holes during installation. Another advantage of thinner sheetmetal is provided in that the lighter guardrail beam 34 may deform locally more readily during a crash event, as opposed to propagating large inertial shock or vibration waves through the rest of guardrail beam 34.

The total length of a typical section of guardrail beam 34 measured from leading edge 64 to trailing edge 66 as illustrated in FIG. 1, is approximately twenty-five (25) feet. Other lengths of guardrail section that may include but are not limited to one-half lengths, giving twelve and one-half foot members, are also be provided within the teachings of the present invention.

Figure 4:
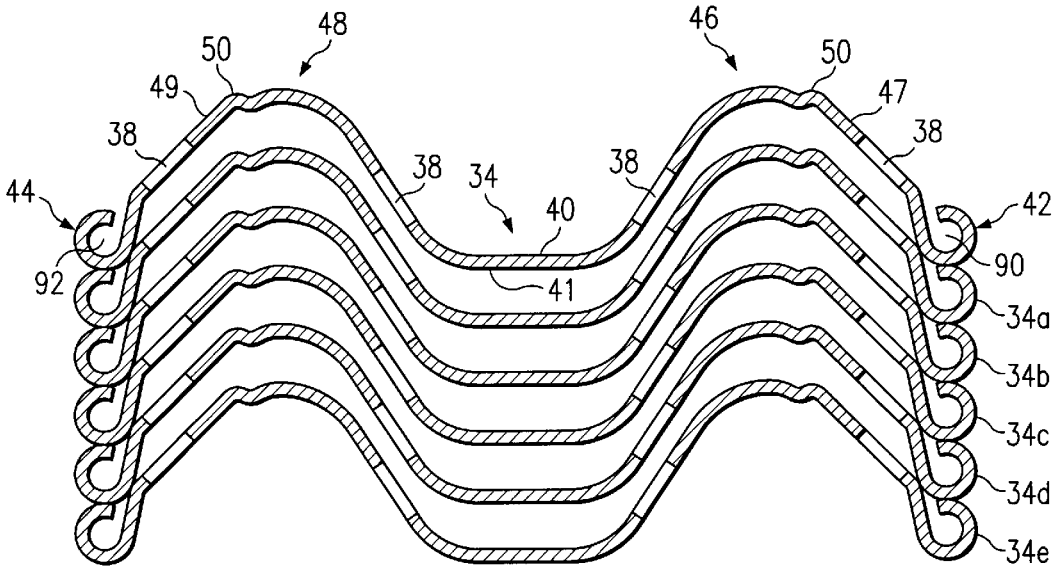
FIG. 4 is a schematic drawing in cross section of a number of guardrail beams stacked upon one another, illustrating aspects of the present invention.

Referring to FIG. 4, guardrail beam 34 may be stacked upon additional guardrail beams 34*a,* 34*b,* 34*c,* 34*d,* and 34*e.* This feature facilitates simplified manufacture, storage, delivery and handling of multiple guardrail beams. Accordingly, substantial savings in material, labor and transportation costs of guardrail beams incorporating aspects of the present invention, may be recognized.

Figure 5:
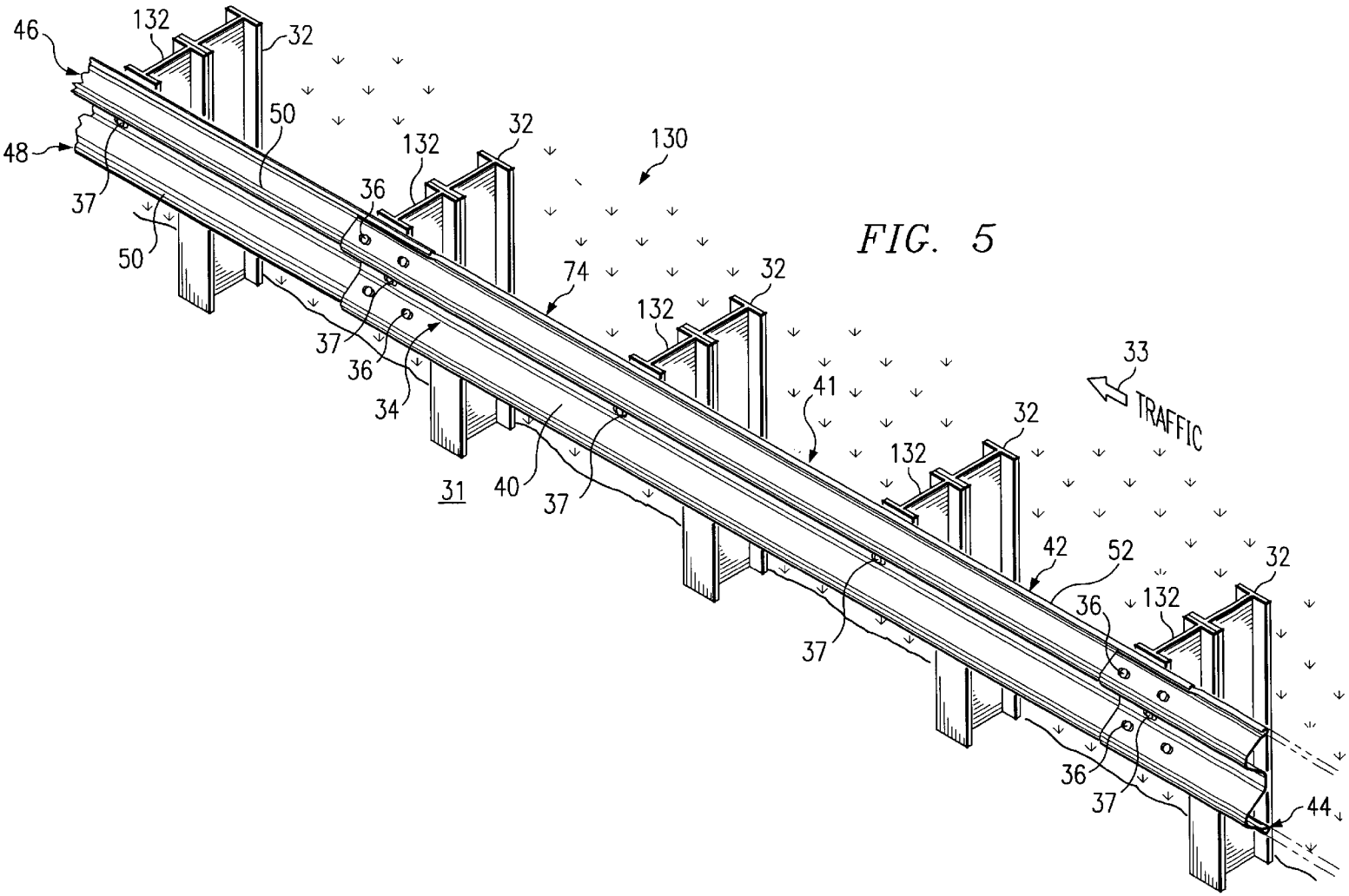
FIG. 5 is an isometric view, with portions broken away, illustrating a guardrail beam, incorporating teachings of the present invention, installed along a roadway using blackouts and support posts.

Having discussed some of the fundamental teachings and novel benefits of the present invention, some further applications are highlighted as follows. Referring to FIG. 5, guardrail system 130 is shown installed adjacent to roadway 31. Guardrail system 130 includes many of the same features and components as previously described guardrail system 30. For the embodiment of the present invention as shown in FIG. 5, guardrail system 130 includes a plurality of blockouts 132 which are disposed between respective support posts 32 and rear face 41 of guardrail beam 34.

Figure 6:
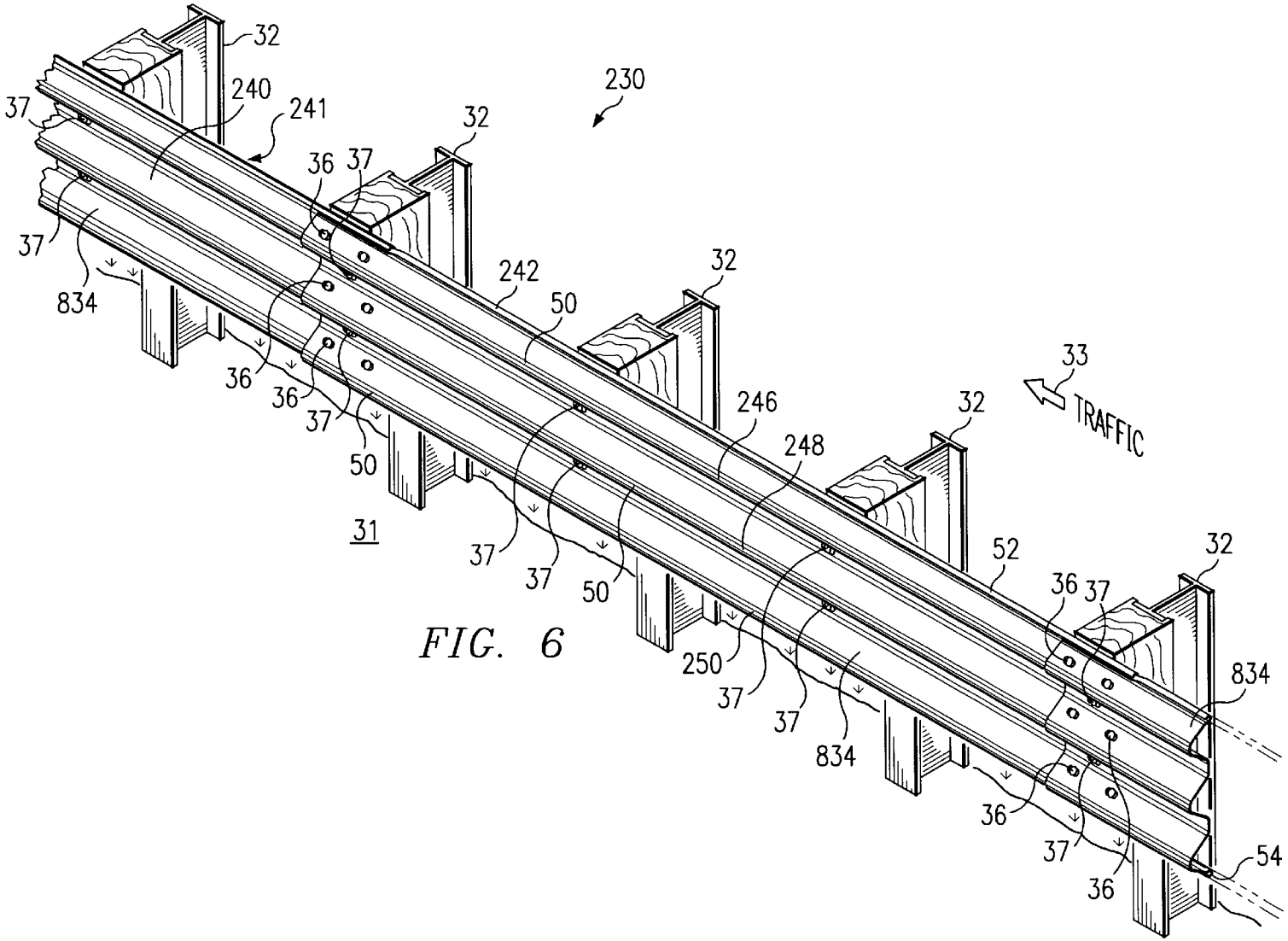
FIG. 6 is an isometric view, with portions broken away, illustrating a guardrail system incorporating still further aspects of the present invention installed along a roadway.

Guardrail system 230 incorporating a further embodiment of the present invention is shown in FIG. 6 installed adjacent to roadway 31. Guardrail system 230 includes a plurality of support posts 32 anchored adjacent to roadway 31 with guardrail beam 834 attached to posts 32 by a plurality of post bolts 37. Guardrail system 230 includes many of the components and features of previously described guardrail system 30. For the embodiment of the present invention as shown in FIG. 6, guardrail beam 34 has been replaced by guardrail beam 834. Guardrail beam 834 as shown in FIGS. 6 and 7 may sometimes be referred to as a thrie-beam.

As best shown in FIGS. 6 and 7, guardrail beam 834 includes a front face 240 and a rear face 241. Guardrail beam 834 is preferably mounted on support post 32 with front face 240 disposed adjacent to roadway 31.

Guardrail beam 834 also includes first edge 242 and second edge 244. For the embodiment of the present invention as shown in FIG. 7, the configuration of first edge 242 corresponds generally with previously described first edge 42 and second edge 244 corresponds generally with previously described second edge 44. Guardrail beam 834 also includes first crown 246, second crown 248 and third crown 250 disposed between first edge 242 and second edge 244. First edge 242, first crown 246, second crown 248, third crown 250 and second edge 244 extend generally parallel with each other along the length of guardrail beam 834. First edge 242 and second edge 244 may include respective folds 52 and 54 which were described in detail with respect to guardrail beam 34.

For the embodiment of the present invention as shown in FIGS. 6 and 7, folds 52 and 54 have the general configuration of previously described tubular curls 90 and 92. First crown 246 and second crown 248 may also include at least one fluted bead 50 such as previously described with respect to guardrail beam 34 while third crown 250 may include a plurality of fluted beads 50.

TABLE I

TYPICAL DIMENSIONS FOR EDGE REGIONS SUCH AS SHOWN IN FIG. 8 WHEN SPECIFICALLY CONFIGURED TO INTERFACE WITH W-BEAM GUARDRAIL

| Dimension | Range | One Application |
|---|---|---|
| d - outer diameter of elliptical curl | average length of major and minor axes equals ⅜ inch to 2½ inches | 0.75 inches |
| θ - angle (positive or negative) | 30 degrees to 120 degrees | 33 degrees |
| R - margin radius between curl flange and respective upper face or lower face | 0.125 inches to 0.32 inches | 0.1875 inches |
| $l_1$ - length from splice bolt slot to curl flange | 0.0625 inches to 0.25 inches | 0.1875 inches |
| $l_2$ - length of splice bolt slot | ⅝ inches to 1 inch | 0.9063 inches |
| $l_3$ - length of curl flange | ¾ inch to 1½ inches | 1.0625 inches |
| t - thickness of guardrail | | 0.07 inches |
| Other dimensions correspond generally with standard W-Beam guardrail. | | |

For some applications, a guardrail beam may be provided with a fold formed in accordance with teachings of the present invention extending along only one longitudinal edge. Also, a guardrail beam may be provided with only one crown having fluted beads formed in accordance with teachings of the present invention.

Although the present invention has been described by several embodiments, various changes and modifications may be suggested to one skilled in the art. It is intended that the present invention encompasses such changes and modifications as fall within the scope of the present appended claims.

What is claimed is:

1. A guardrail beam for installation along a roadway, comprising:

a first edge;

a second edge;

a plurality of crowns disposed longitudinally along the guardrail beam between the first edge and the second edge;

a first fold disposed longitudinally along the first edge;

a second fold disposed longitudinally along the second edge;

an upstream end;

a downstream end spaced longitudinally from the upstream end;

an intermediate portion disposed between the upstream end and the downstream end, wherein the first and second folds form generally tubular first and second curls within the upstream and intermediate portion;

the first curl and the second curl each having an elliptical cross section wherein the minor axis is at least twenty percent of the major axis and an outer diameter with a value between approximately 0.375 inches and 2.5 inches; and the first and second folds forming respective first and second modified fold portions at the downstream end.

2. The guardrail beam of claim 1, further comprising a plurality of post bolt slots disposed within the guardrail beam for attaching the guardrail beam to a plurality of support posts associated with a conventional guardrail system.

3. The guardrail beam of claim 1, wherein the guardrail beam comprises sheetmetal having a generally uniform thickness; and the ratio of the outer diameter of the first and second curls to the guardrail beam thickness is approximately equal to or less than 15.

4. The guardrail beam of claim 1, wherein a circumference associated with each of the first and second curls is approximately within the range of 200 to 290 degrees.

5. The guardrail beam of claim 1, further comprising a curl flange forming a transition between an upper face of the guardrail beam and the first curl.

6. The guardrail beam of claim 5, wherein the curl flange has a length with a value between approximately 0.75 inches and 1.5 inches.

7. The guardrail beam of claim 5, further comprising:

the angle formed between the curl flange and the upper face having a value of between approximately thirty degrees and one hundred and twenty degrees in either a positive or negative direction; and the bend radius formed between the curl flange and the upper face is approximately equal to or less than three times the guardrail beam thickness.

8. The guardrail beam of claim 1, wherein the first and second modified fold portions extend approximately thirteen inches longitudinally along the downstream end of the guardrail beam.

9. The guardrail beam of claim 8, wherein edges associated with the first and second modified fold portions are chamfered.

10. The guardrail beam of claim 1, further comprising a plurality of splice bolt slots disposed within the guardrail beam wherein the splice bolt slots are configured to allow the guardrail beam to be installed upon conventional guardrail systems.

11. The guardrail beam of claim 1, further comprising a curl flange forming a transition between a lower face of the guardrail beam and the second curl.

12. The guardrail beam of claim 11 wherein the curl flange has a length with a value between approximately 0.75 inches and 1.5 inches.

13. A guardrail beam for installation along a roadway, comprising:

a first edge;

a second edge;

a plurality of crowns disposed longitudinally along the guardrail beam between the first edge and the second edge;

a second fold disposed longitudinally along the second edge;

an upstream end;

a downstream end spaced longitudinally from the upstream end;

an intermediate portion disposed between the upstream end and the downstream end, wherein the first and second folds form generally tubular first and second curls within the upstream and intermediate portion;

the first and second fold forming respective first and second modified fold portions at the downstream end; and at least one fluted bead disposed longitudinally along at least one crown, the at least one fluted bead having a radius with a value between approximately 0.125 inches and 0.32 inches.

14. A guardrail beam for installation along a roadway, comprising:

a first edge;

a second edge;

at least one crown disposed longitudinally along the guardrail beam between the first edge and the second edge; and at least one fluted bead disposed longitudinally along the at least one crown, the at least one fluted bead having a radius with a value between approximately 0.125 inches and 0.32 inches.

15. The guardrail beam of claim 14, further comprising a first fold disposed upon the first edge, and a second fold disposed upon the second edge.

16. The guardrail beam of claim 15 wherein at least a portion of the first and second folds form respective first and second modified fold portions.

17. The guardrail beam of claim 15 wherein at least a portion of the first and second folds form first and second tubular curls of circular cross section, the first and second tubular curls each having an outer diameter with a value between approximately 0.375 inches and 2.5 inches.

18. The guardrail beam of claim 14 further comprising:

an upstream end;

a downstream end spaced longitudinally from the upstream end;

an intermediate portion disposed between the upstream end and the downstream end;

a first tubular curl of circular cross section disposed upon the first edge at the upstream end and the intermediate portion, the first tubular curl having an outer diameter with a value between approximately 0.375 inches and 2.5 inches;

a second tubular curl of circular cross section disposed upon the second edge at the upstream end and the intermediate portion, the second tubular curl having an outer diameter with a value between approximately 0.375 inches and 2.5 inches;

a first hemmed portion disposed on the first edge at the downstream end; and a second hemmed portion disposed on the second edge at the downstream end.

19. A guardrail beam for installation along a roadway, comprising:

a first edge;

a second edge;

at least one crown disposed longitudinally along the guardrail beam between the first edge and the second edge; and a first fold disposed longitudinally along the first edge, the first fold forming a generally tubular first curl, the first curl having an elliptical cross section wherein the minor axis is at least twenty percent of the major axis and an outer diameter with a value between approximately 0.375 inches and 2.5 inches.

20. A guardrail beam for installation along a roadway, comprising:

a first edge;

a second edge;

at least one crown disposed longitudinally along the guardrail beam between the first edge and the second edge; and a first fold disposed longitudinally along the first edge, the first fold forming a generally tubular first curl, the first curl having an elliptical cross section wherein the minor axis is at least twenty percent of the major axis and an outer diameter with a value between approximately 0.375 inches and 2.5 inches;

at least one fluted bead disposed longitudinally along the at least one crown; and the at least one fluted bead having a radius with a value between approximately 0.125 inches and 0.32 inches.

* * * * *